US006886369B2

(12) United States Patent
Fukuro et al.

(10) Patent No.: US 6,886,369 B2
(45) Date of Patent: May 3, 2005

(54) FLAT MULTIFILAMENT YARN KNITTED FABRIC

(75) Inventors: Tadayuki Fukuro, Osaka (JP); Tsuyoshi Soeda, Osaka (JP)

(73) Assignee: Teijin Fibers Limited, Osaka (JP)

( * ) Notice: Subject to any disclaimer, the term of this patent is extended or adjusted under 35 U.S.C. 154(b) by 0 days.

(21) Appl. No.: 10/492,356

(22) PCT Filed: Jul. 14, 2003

(86) PCT No.: PCT/JP03/08908

§ 371 (c)(1),
(2), (4) Date: Apr. 13, 2004

(87) PCT Pub. No.: WO2004/009895

PCT Pub. Date: Jan. 29, 2004

(65) Prior Publication Data

US 2004/0237598 A1 Dec. 2, 2004

(30) Foreign Application Priority Data

Jul. 22, 2002 (JP) ..... 2002-212261

(51) Int. Cl.[7] ..... D04B 1/16
(52) U.S. Cl. ..... 66/202; 68/169 R
(58) Field of Search ..... 66/202, 169 R, 66/170; 442/195, 309; 428/397, 400

(56) References Cited

U.S. PATENT DOCUMENTS 4,643,119 A * 2/1987 Langston et al. ..... 66/202

FOREIGN PATENT DOCUMENTS

| | | | |
|---|---|---|---|
| JP | 57-51808 | A | 3/1982 |
| JP | 59-228070 | A | 12/1984 |
| JP | 62-6983 | A | 1/1987 |
| JP | 63-59454 | A | 3/1988 |
| JP | 2-221411 | A | 9/1990 |
| JP | 2-234915 | A | 9/1990 |
| JP | 4-24214 | A | 1/1992 |
| JP | 11-222721 | A | 8/1999 |
| JP | 2000-170061 | A | 6/2000 |

* cited by examiner

*Primary Examiner*—Danny Worrell
(74) *Attorney, Agent, or Firm*—Sughrue Mion, PLLC

(57) ABSTRACT

A flat multifilament yarn knitted fabric having excellent bulkiness, drape, and water•sweat-absorbability is a knitted fabric comprising multifilament yarns each comprising a plurality of flat cross section shape-having filaments comprising a fiber-forming thermoplastic polymer as a main component. In the above-described flat cross section, three or more expanded portions expanded toward the outside of the longitudinal central line of the flat cross section per half side of the flat cross section, and two or more constricted portions formed between the expanded portions per half side are approximately symmetrically formed on both the sides of the longitudinal central line with respect to the above-described longitudinal central line. Cross section flatness represented by the ratio (B/C1) of the length (B) of the above-described modified cross section in the direction of the longitudinal central line to the maximum width (C1) in the direction orthogonal to the direction of the longitudinal central line is in a range of 2 to 6. The above-described multifilament yarns are comprised in the knitted fabric in an amount of 50 to 100 percent by weight based on the total weight of the knitted fabric.

9 Claims, 1 Drawing Sheet

FLAT MULTIFILAMENT YARN KNITTED FABRIC

TECHNICAL FIELD

The present invention relates to a flat multifilament yarn knitted fabric. In more detail, the present invention relates to a knitted fabric which comprises multifilament yarns comprising flat and two or more constricted portion-having filaments and has bulkiness, excellent drape and high water absorbability.

BACKGROUND ART

Hitherto, many knitted fabrics have been proposed in the fields of inner wears represented by underwear, sports wears, and the like. Since the knitted fabrics for the inner wears among them are directly brought into contact with the skins, excellent drape, bulkiness and water absorbability are required.

On the other hand, fibers comprising a fiber-forming thermoplastic polymer such as a polyester or a polyamide have been used in a wide range from clothing uses to industrial uses due to the excellent characteristics of the fibers. Polyester fibers among the fibers have widely been used as yarns constituting woven fabrics, because of having many excellent characteristics such as excellent fiber strengths, dimensional stability and easy care property.

However, there has been a problem that the drape of a knitted fabric has been deteriorated, when yarns comprising a fiber-forming thermoplastic polymer are subjected to a false-twisting and crimping treatment and then knitted into the knitted fabric to enhance its bulkiness.

Such the drape and the bulkiness are generally the mutually conflicting properties. For example, there has been a problem that the bulkiness of a knitted fabric has been deteriorated, when the knitted fabric is subjected to an alkali reduction treatment to enhance the drape of the knitted fabric or when twisted yarns are knitted into the knitted fabric to enhance its drape.

Additionally, the water absorbability of a knitted fabric formed from yarns comprising a fiber-forming thermoplastic polymer is usually insufficient. The improvement of the water absorbability has therefore been required.

As a knitted fabric having the water absorbability and the drape, a knitted fabric comprising multifilament yarns each comprising a plurality of flat W-shaped cross section shape-having filaments has been proposed in JP-A 11-222721 (hereinafter, JP-A means "Japanese Unexamined Patent Publication").

However, such the knitted fabric comprising the multifilament yarns each comprising a plurality of the flat W-shaped cross section shape-having filaments has excellent water absorbability, but is still insufficient at the point of the drape.

DISCLOSURE OF INVENTION

The object of the present invention is to provide a knitted fabric having bulkiness, excellent drape and high water absorbability. The above-described object can be achieved with the flat multifilament yarn knitted fabric of the present invention.

The flat multifilament yarn knitted fabric of the present invention is a knitted fabric comprising multifilament yarns each comprising a plurality of flat cross section shape-having filaments comprising a fiber-forming thermoplastic polymer as a main component, characterized in that three or more expanded portions expanded toward the outside of the longitudinal central line of the flat cross section of the above-described filament per half side of the flat cross section and two or more constricted portions formed between the expanded portions per half side are formed on both the sides of the longitudinal central line, approximately symmetrically with respect to the above-described longitudinal central line, in the flat cross section of the filament;

cross section flatness represented by the ratio (B/C1) of the length (B) of the above-described modified cross section in the direction of the longitudinal central line to the maximum width (C1) in the direction orthogonal to the direction of the longitudinal central line is in a range of 2 to 6; and the above-described multifilament yarns are comprised in the knitted fabric in an amount of 50 to 100 percent by weight based on the total weight of the knitted fabric.

Therein, the above-described fiber-forming thermoplastic polymer is preferably selected from polyesters, polyamides, polyvinylidene chloride, and polypropylene.

Further, in the flat cross section of the above-described filament, it is preferable that the ratio (C1/C2) of the maximum width (C1) to the minimum width (C2) is 1.05 to 4.00.

It is preferable that the above-described multifilament yarns contains a matting agent in an amount of not less than 0.2 percent by weight, because more excellent drape is obtained. The total fineness of such the multifilament yarn is preferably 20 to 170 dtex, and the fineness of the single filament is preferably 0.5 to 5 dtex.

In the flat multifilament yarn knitted fabric of the present invention, it is preferable that the knit construction is a knit construction selected from ponti roma, Milano rib, tuck rib, back seed stitch (back Kanoko), single pique, double pique, half, satin, back half, queens cord, shark skin, double raschel, and double tricot.

In the flat multifilament yarn knitted fabric of the present invention, it is preferable that a K value determined by the following expression is not more than $35\times10^3$, as the whole of the knitted fabric. When such the K value is more than $35\times10^3$, the bulkiness is liable to is deteriorated.

$$K=Co\times We\times(D/1.1)^{1/2}$$

wherein Co is the courses (courses/2.54 cm) of the knitted fabric; We is the wales (wales/2.54 cm) of the knitted fabric; D is the average value (dtex) of the total finenesses of the yarn constituting the knitted fabric.

In the flat multifilament yarn knitted fabric of the invention, it is preferable that the bulkiness of the knitted fabric, measured by JIS L 1018-1998, 6. 20, is not less than 2.1 $cm^3/g$. Further, it is preferable that the flexural rigidity of the knitted fabric, measured by a KES hand-measuring system, is not more than 0.02 $cN\cdot cm^2/cm$. Furthermore, it is preferable that the water-absorbing speed of the knitted fabric, measured by JIS L 1096-1998, 6. 26, 1(2) B method (Byreck method), is not less than 30 mm.

BEST MODE FOR CARRYING OUT THE INVENTION

The inventors of the present invention have found the following. In a knitted fabric comprising multifilament yarns each comprising a plurality of flat cross section shape-having filaments comprising a fiber-forming thermoplastic polymer as a main component, wherein three or more, preferably four or more, further preferably four to six, expanded portions expanded toward the outside of the longitudinal central line of the flat cross section of the above-described filament per half side of the flat cross section and two or more, preferably three or more, further preferably three to five, constricted portions formed between the expanded portions per half side are formed on both the sides of the longitudinal central line, approximately symmetrically with respect to the above-described longitudinal central line, in the flat cross section of the filament, and further wherein cross section flatness represented by the ratio (B/C1) of the length (B) of the above-described modified cross section in the direction of the longitudinal central line to the maximum width (C1) in the direction orthogonal to the direction of the longitudinal central line is controlled within a range of 2 to 6, excellent bulkiness is obtained, because the flat multifilament yarns are tightly brought into contact with each other on their flat surfaces at the connection points of the knitted fabric construction due to the contact pressure of the construction and simultaneously slipped and spread to form the loops of the knitted fabric, and high flexibility at the connection points of the knitted fabric construction and excellent drape are also obtained, because the surfaces of the mutually overlapped flat filaments are roughed with the expanded portions and the constricted portions to reduce frictional resistance between the filaments.

Further, the inventors of the present invention have found that the constricted portions formed on the flat surfaces of the flat multifilament yarns develop capillary phenomena for liquids, whereby the knitted fabric of the present invention exhibits excellent water absorbability and excellent sweat absorbability for water and sweat, respectively.

The present invention has been completed on the basis of the above-described findings.

The flat multifilament yarn knitted fabric of the present invention is the knitted fabric comprising the multifilament yarns each comprising a plurality of the flat cross section shape-having filaments comprising the fiber-forming thermoplastic polymer as the main component.

Figure 1:
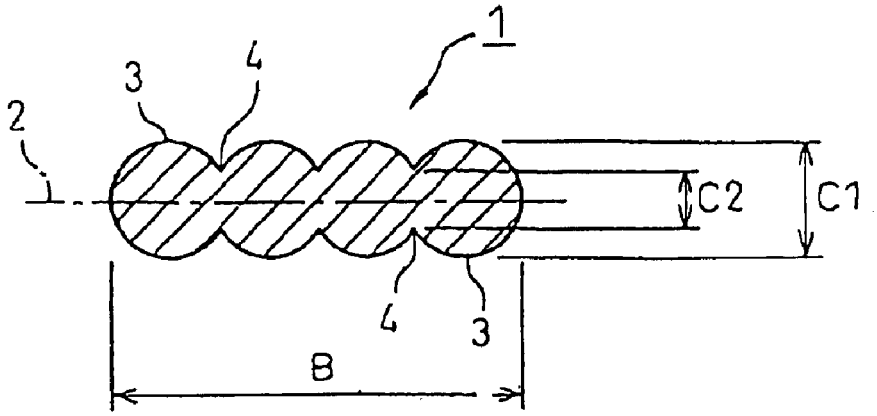
FIG. 1 is an explanatory drawing showing an example of the cross section shape of each of the filaments constituting the flat multifilament yarns comprised in the flat multifilament yarn knitted fabric of the present invention.

In the above-described multifilament yarn, the cross section shape of the single filament is a shape in which the width in the direction vertical to the longitudinal central line is relatively shorter than the length of the central line, namely a flat shape, for example, as shown in FIG. 1.

In the cross section 1 shown in FIG. 1, three or more (four in the FIG. 1) expanded portions 3 expanded toward the outside of the longitudinal central line 2 per half side of the cross section and two or more (three in FIG. 1) constricted portions formed between the expanded portions 3 per half side are formed on both the sides of the longitudinal central line, symmetrically with respect to the longitudinal central line.

Herein, the expanded portions formed on one side are approximately symmetrically placed to the expanded portions formed on the other side with respect to the longitudinal central line, and the constricted portions formed on one side are also approximately symmetrically placed to the constricted portions formed on the other side with respect to the longitudinal central line. But it is not necessary that the shapes of the expanded portions and the constricted portions formed on both the sides are perfectly symmetrical.

In the cross section of FIG. 1, the cross section flatness represented by the ratio (B/C1) of the maximum length (B) in the longitudinal direction to the maximum width (C1) in the direction orthogonal to the longitudinal direction is in a range of 2 to 6.

In the cross section of the single filament in the above-described flat multifilament yarn, the number of the expanded portions is three or more, preferably four or more, further preferably four to six, per one side, as described above. The number of the constricted portions is also two or more, preferably three or more, further preferably three to five, per one side, as described above. Additionally, the cross section flatness is 2 to 6, preferably 3 to 5, as described above.

When the number of the expanded portions is two or less, thereby, when the number of the constricted portion is one or less per one side, frictional resistance on the peripheral surface of the filament is enlarged, and the spreading of the knitted fabric construction due to the pressure contact at the connection points is insufficient. The water•sweat absorbability of the obtained knitted fabric is also insufficient, because the constricted portions on the peripheral surface of the filament are reduced.

In the flat multifilament yarn knitted fabric of the present invention, the cross section flatness (B/C1) in the cross section of the single filament in the flat multifilament yarn is 2 to 6, preferably 3 to 5, as described above. When the cross section flatness is less than 2, the flexural rigidity of the filament is enhanced, and the desired drape is therefore not obtained. Further, when the cross section flatness is less than 2, the spreading of the multifilament yarns due to the pressure contact in the knitted fabric, especially at the connection points of the knitted fabric construction, is insufficient, and the desired drape is therefore not obtained.

In the cross section shape of the single filament in the flat multifilament yarn used in the knitted fabric of the present invention, the ratio (C1/C2) of the maximum width (C1) in the direction orthogonal to the longitudinal central line to the minimum value (C2) is preferably 1.05 to 4.00, more preferably 1.10 to 2.50. The above-described ratio (C1/C2) is a parameter related to the depth of the constricted portion of the single flat filament. When the ratio (C1/C2) is less than 1.05, namely when the depth of the constricted portion is small, frictional resistance between the filaments is enlarged. Thereby, flexibility at the connection points of the knitted fabric construction is often deteriorated, and the drape of the knitted fabric is therefore often insufficient. Further, the water•sweat absorbability of the knitted fabric is often insufficient. When the ratio (C1/C2) exceeds 4.0, the depth of the constricted portion is excessively enlarged, and the action effect is saturated. Furthermore, troubles such as the unstableness of fiber productivity, the development of cracks in the constricted portion, and the deterioration in the uniformity of the filament cross section are often caused.

Figure 2:
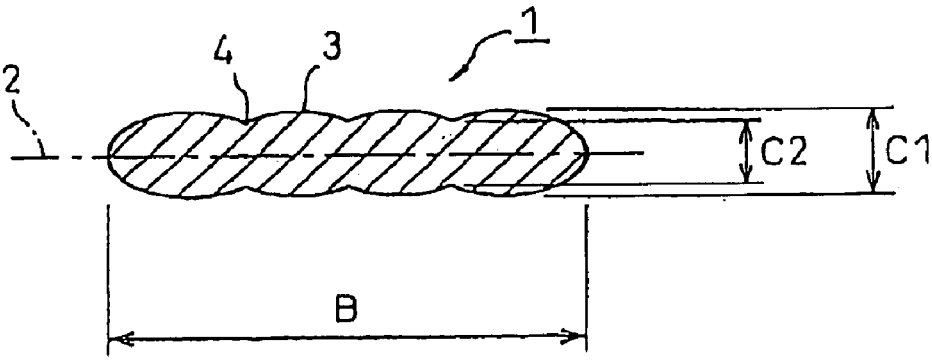
FIG. 2 is an explanatory drawing showing the other example of the cross section shape of each of the filaments constituting the flat multifilament yarns comprised in the flat multifilament yarn knitted fabric of the present invention.
Figure 3:
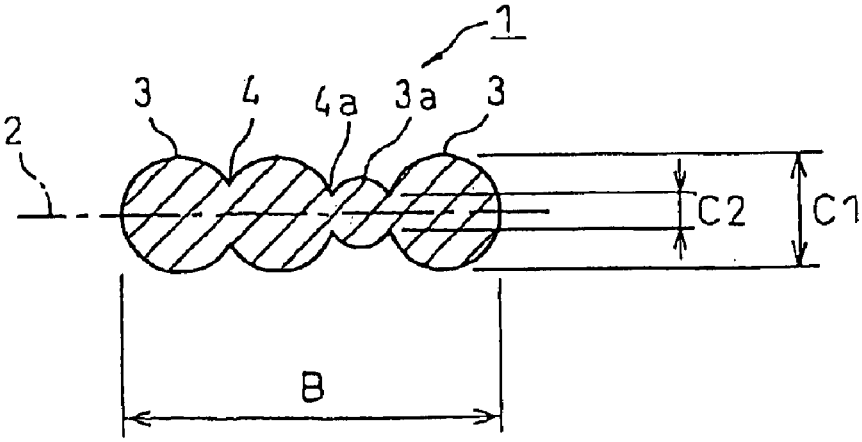
FIG. 3 is an explanatory drawing showing the further other example of the cross section shape of each of the filaments constituting the flat multifilament yarns comprised in the flat multifilament yarn knitted fabric of the present invention.

The other examples of the cross section shape of the single filament in the flat multifilament yarn used in the flat multifilament yarn woven of the present invention are shown in FIGS. 2 and 3, respectively.

The cross section of the filament 1 shown in FIG. 2 has the same shape as the cross section shape described in FIG. 1 on both the sides of the longitudinal central line 2, but the cross section shape of the expanded portion 3 is gentle like an arc along the major axis of an ellipse. Thereby, the depth of the constricted portion 4 is small.

The cross section of the filament 1 shown in FIG. 3 has four expanded portions and three constricted portions per one side on both the sides of the longitudinal central line, but the width and height of one expanded portion 3*a* are smaller than those of the other expanded portions. Thereby, the depths of the valley bottoms of the constricted portions 4*a* on both the sides from the tips of the expanded portion 3*a* are smaller than those of the other constricted portion 4.

Next, the filaments constituting the multifilament yarns comprise the fiber-forming thermoplastic polymer. Said fiber-forming thermoplastic polymer is especially not limited, and includes polyesters represented by polyethylene terephthalate and polytrimethylene terephthalate, polyamides, polyvinylidene chloride, polypropylene, and their copolymers copolymerized with the third components. Among them, the polyesters are preferably exemplified, because of being easily produced.

And, it is preferable on the acquisition of more excellent drape that said fiber-forming thermoplastic polymer contains a matting agent in an amount of not less than 0.2 percent by weight (more preferably 1.0 to 3.5 percent by weight, especially preferably 1.5 to 2.8 percent by weight). Such the matting agent includes known inorganic fine particles such as titanium dioxide.

Except the matting agent, the above-described fiber-forming thermoplastic polymer may, if necessary, furthermore contain one or more additives selected from fine pore-forming agents (for example, metal organic sulfonates), cation dye-dyeable agents (for example, isophthalic acid sulfonium salts), antioxidizing agents (for example, hindered phenol-based antioxidizing agents), heat stabilizers, flame retardants (for example, antimony trioxide), fluorescent brightening agents, colorants, antistatic agents (for example, metal sulfonates), moisture absorbents (for example, polyoxyalkylene glycols), and the like.

The total fineness of said multifilament yarn and the fineness of said single filament are especially not limited, but it is preferable on the acquisition of bulkiness, excellent drape and high water absorbability that the total fineness of the multifilament yarn and the fineness of the single filament are 20 to 170 dtex (more preferably 30 to 100 dtex) and 0.5 to 5 dtex (more preferably 1 to 4 dtex), respectively.

In the flat multifilament yarn used the flat multifilament yarn knitted fabric of the present invention, the twist rate of the yarn is especially not limited, can suitably be set, but is generally preferably 0 to 2,500 T/m, more preferably 0 to 600 T/m, especially preferably 0 T/m (untwisted), on the acquisition of excellent drape.

The multifilament yarn used in the present invention may be subjected to a twisting treatment such as a false twisting treatment or to an air treatment such as Taslan treatment or an interlacing treatment, so long as the objective knitted fabric of the present invention is obtained.

It is necessary that such the multifilament yarns are contained in an amount of 50 to 100 percent by weight, preferably 60 to 100 percent by weight, especially preferably 100 percent by weight, based on the total amount of the knitted fabric. The smaller content of said multifilament yarns than 50 percent by weight is not preferable, because sufficient bulkiness, drape and sweat absorbability are not obtained. When the content of the multifilament yarns is not less than 50 percent by weight, the flat multifilament yarn knitted fabric of the present invention may be interknitted with a different kind of yarns. The above-described different kind of yarns include monofilament yarns, multifilament yarns and spun yarns, and may have one or more special functions such as an antistatic function and a brightening function. Further, the flat multifilament yarns may singly constitute the knitted fabric or constitute the knitted fabric together with a different kind of yarns in the form of composite yarns such as twisted yarns or air blended yarns.

In the flat multifilament yarn knitted fabric of the present invention, the density of the knitted fabric is especially not limited, but the ranges of 40 to 80 courses/2.54 cm (more preferably 50 to 70 courses/2 54 cm) and 30 to 70 wales/2.54 cm (more preferably 40 to 65 wales/2.54 cm) are suitable for satisfying both the performances of drape and bulkiness.

Especially, it is preferable that a coefficient K determined by the following expression is not more than $35\times10^3$ (preferably $17\times10^3$ to $30\times10^3$, especially preferably $20\times10^3$ to $28\times10^3$).

$$K=Co\times We\times(D/1.1)^{1/2}$$

wherein Co is the courses (courses/2.54 cm) of the knitted fabric; We is the wales (wales/2.54 cm) of the knitted fabric; D is the average value (dtex) of the total finenesses of the yarn constituting the knitted fabric.

When the above-described K value is larger than $35\times10^3$, the K value is not preferable, because sufficient bulkiness is not obtained. When said K value is conversely less than $17\times10^3$, sweat absorption may be deteriorated.

In the flat multifilament yarn knitted fabric of the present invention, the knit construction is especially not limited, and a known knit construction such as a warp knit construction or a circular knit construction can be used. For example, circular knitted fabrics such as ponti roma, Milano rib, tuck rib, back seed stitch (back Kanoko), single pique and double pique, single warp knitted fabrics such as half, satin, back half, queens cord and shark skin, and double warp knitted fabrics such as double raschel, and double tricot are cited.

The flat multifilament yarn knitted fabric of the present invention can be produced, for example, by spinning with a spinneret having such the shape nozzles as shown in FIG. 2C at page 5 in JP-A 56-107044 to obtain the flat multifilament yarn, if necessary, combining the obtained flat multifilament yarn with a different kind of yarn to form the composite yarn, and then knitting the composite yarn by an ordinary knitting method. The knitted fabric of the present invention can be dyed and finished by ordinary methods. When the flat multifilament yarn is a polyester yarn, an alkali reduction treatment can be applied to said knitted fabric. In the finishing treatment, one or more of a water absorbability-promoting treatment (for example, a treatment for coating or impregnating a water-absorbing agent such as an anionic hydrophilic polymer), a water-repelling treatment (for example, a treatment for coating or impregnating a water-repelling agent such as a fluorinated compound), an ultraviolet light-screening treatment (for example, a treatment for coating or impregnating a finely particulate metal oxide), an antistatic treatment, a deodorizer-imparting treatment, a mothproofing agent-imparting treatment, and a luminous agent treatment may simultaneously or sequentially be applied.

In the flat multifilament yarn knitted fabric of the present invention, bulkiness measured according to JIS L 1018-

1998, 6. 20 is preferably not less than 2.1 $cm^3/g$, especially preferably 2.2 to 3.0 $cm^3/g$.

Further, in the flat multifilament yarn knitted fabric of the present invention, flexural rigidity measured with a KES hand-measuring system as drape is preferably not more than 0.02 $cN \cdot cm^2/cm$, especially preferably 0.010 to 0.018 $cN \cdot cm^2/cm$.

Furthermore, in the flat multifilament yarn knitted fabric of the present invention, water-absorbing speed measured by JIS L 1018-1998, 6. 26, 1(2) B method (Byreck method) is preferably not less than 30 mm, especially preferably 50 to 70 mm.

In the flat multifilament yarn woven fabric of the present invention, excellent bulkiness is obtained, because the flat multifilament yarns constituting the knitted fabric are slipped on the mutual contact surfaces of the mutually contacting single filaments with contact pressures at the connection points of the knitted fabric construction, flattened, and simultaneously spread in the lateral direction to form the loops of the knitted fabric.

Further, in the flat multifilament yarn woven fabric of the present invention, the knitted fabric exhibiting lowered bending resistance, improved flexibility and excellent drape is obtained by the above-described flattening of the yarns. Additionally, the peripheral surface of the single filament in the flat multifilament yarn is roughened with three or more expanded portions per one side and with two or more constricted portions formed therebetween. Even when the single filaments contact with each other or even when the single filaments are brought into press contact with each other at the connection points of the knitted fabric construction, the contact area between the single filaments is small. Thereby, the surface frictional resistance is reduced to contribute to the improvement in the drape of the knitted fabric. Further, even when the single filaments contact with each other, the constricted portions on the peripheral surfaces of the single filaments are not or slightly closed. Therefore, water or sweat is easily diffused by the capillary phenomena of the constricted portions, and the obtained knitted fabric exhibits excellent water absorbability and sweat absorb ability.

The flat multifilament yarn knitted fabric of the present invention is suitably used as a material for various clothes, for example, for inner wears such as underwear and sports wears, because of having the high bulkiness, excellent drape, and high water•sweat absorbability.

EXAMPLES

The present invention will be explained in more detail hereafter with the following examples, but the present invention is not limited to the examples. Therein, measurement items in Examples were measured by the following methods, respectively.

(1). Water Absorbability

The water absorbability was measured by JIS L 1096-1998, 6. 26, 1(2) B method with the number n of 5, and the average value was calculated.

(2). Bulkiness

The bulkiness was measured by JIS L 1018-1998, 6. 20 with the number n of 5, and the average value was calculated.

(3). Flexural Rigidity

The flexural rigidity was measured with KES (Kawabata Evaluation System) hand-measuring system (type KESFB2, manufactured by Kato Tech Co.) with the number n of 5, and the average value was calculated.

(4). Hand

The hand was classified into the following five grades with hand touch and evaluated.

5 grade: extremely high flexibility, extremely excellent hand.

4 grade: high flexibility, excellent hand.

3 grade: good flexibility, good hand.

2 grade: slightly insufficient flexibility, slightly dissatisfactory hand.

1 grade: bad flexibility, bad hand.

(5). Over-all Evaluation

The over-all evaluation was classified into the following four grades.

4 grade: extremely excellent.

3 grade: excellent.

2 grade: slightly dissatisfactory.

1 grade: bad.

Example 1

Polyethylene terephthalate resin containing titanium dioxide in an amount of 2.5 percent by weight as a matting agent was extruded at a spinning temperature of 300° C. through thirty melt-spinning holes (each hole has four circular expanded portions and three constricted portions formed between the expanded portions per one side on both the sides of the longitudinal central line) opened in a spinneret and each having a shape corresponding to the filament cross section shape shown in FIG. 1. The extruded filament-like melted polymer flows are cooled and solidified and simultaneously taken off at a take-off speed of 4,000 m/min. The obtained undrawn multifilaments were not wound up and immediately drawn at a draw ratio of 1.3 at a temperature of 97° C. to produce the drawn multifilament yarn having a yarn count of 84 dtex/30 filaments. This drawn multifilament yarn comprised the filaments each having the cross section shape shown in FIG. 1. The cross section flatness of the cross section shape of each filament was 3.2, and a ratio C1/C2 value in the cross section width of the filament was 1.2.

Subsequently, said flat multifilament yarns thus produced were fed into a front reed and a back reed in an untwisted state, and then knitted by an ordinary knitting method (tricot knitting machine, 28G) to obtain the knitted fabric containing 100% of the above-described flat multifilament yarns and having a half knit construction (back: 12/10, front: 10/23). The knitted fabric was subjected to ordinary dyeing and finishing treatments. The finished knitted fabric had a knit density (62 courses/2.54 cm, 50 wales/2.54 cm, K value $26.84 \times 10^3$).

In said knitted fabric, sweat absorbability: 56 mm, bulkiness: 2.27 $cm^3/g$, flexural rigidity: 0.017 $cN \cdot cm^2/cm$, hand: 5 grade, over-all evaluation: 4 grade.

Example 2

A flat multifilament yarn knitted fabric was obtained similarly to Example 1, except that the knit density was changed into a knit density (70 courses/2.54 cm, 50 wales/2.54 cm, K value $30 \times 10^3$), while using the same yarns.

In said knitted fabric, sweat absorbability: 57 mm, bulkiness: 2.20 $cm^3/g$, flexural rigidity: 0.018 $cN \cdot cm^2/cm$, hand: 4 grade, over-all evaluation: 3 grade.

Example 3

A flat multifilament yarn knitted fabric was obtained similarly to Example 1, except that the content of the titanium dioxide was changed to 0.2 percent by weight.

In said knitted fabric, sweat absorbability: 56 mm, bulkiness: 2.20 $cm^3/g$, flexural rigidity: 0.018 $cN \cdot cm^2/cm$, hand: 5 grade, over-all evaluation: 3 grade.

Comparative Example 1

A knitted fabric was obtained similarly to Example 1, except that the cross section shape of the filament was changed to a circular cross section.

In said knitted fabric, sweat absorbability: 25 mm, bulkiness: 2.08 $cm^3/g$, flexural rigidity: 0.024 $cN \cdot cm^2/cm$, hand: 2 grade, over-all evaluation: 1 grade.

Comparative Example 2

A knitted fabric was obtained similarly to Example 1, except that the knitted fabric having the same half knit construction as in Example 1 was made by feeding all of the multifilament yarns used in Comparative Example 1 into the back reed and alternately feeding four of the multifilament yarns used in Comparative Example 1 and one of the flat multifilament yarns used in Example 1 into the front reed, so that the content of the flat multifilament yarns used in Example 1 and the content of the multifilament yarns used in Comparative Example 1 were 10 percent by weight and 90 percent by weight, respectively.

In said knitted fabric, sweat absorbability: 28 mm, bulkiness: 2.10 $cm^3/g$, flexural rigidity: 0.022 $cN \cdot cm^2/cm$, hand: 3 grade, over-all evaluation: 2 grade.

Industrial Applicability

The flat multifilament yarn knitted fabric of the present invention has excellent bulkiness and drape, because the single filaments well slip due to their special cross section shapes and further because the yarns are flattened and spread in the lateral direction at the connection points of the knitted fabric construction with contact pressures to form the loops of the knitted fabric, and further has excellent water absorbability and sweat absorbability. Thereby, the flat multifilament yarn knitted fabric of the present invention is useful as a knitted fabric for inner wears such as underwear and as a sports wear.

What is claimed is:

1. A flat multifilament yarn knitted fabric comprising multifilament yarns each comprising a plurality of flat cross section shape-having filaments comprising a fiber-forming thermoplastic polymer as a main component, characterized in that three or more expanded portions expanded toward the outside of the longitudinal central line of the flat cross section of the above-described filament per half side of the flat cross section and two or more constricted portions formed between the expanded portions per half side are formed on both the sides of the longitudinal central line, approximately symmetrically with respect to the above-described longitudinal central line, in the flat cross section of the filament;

cross section flatness represented by the ratio (B/C1) of the length (B) of the above-described modified cross section in the direction of the longitudinal central line to the maximum width (C1) in the direction orthogonal to the direction of the longitudinal central line is in a range of 2 to 6;

and the above-described multifilament yarns are comprised in the knitted fabric in an amount of 50 to 100 percent by weight based on the total weight of the knitted fabric wherein a K value determined by the following expression is not more than $35 \times 10^3$, as the whole of the above-described knitted fabric, $$K = Co \times We \times (D/1.1)^{1/2}$$

wherein Co is the course number (courses/2.54 cm) of the knitted fabric; We is the wale number (wales/2.54 cm) of the knitted fabric; and D is the average value (dtex) of the total finenesses of the yarns constituting the knitted fabric.

2. The flat multifilament yarn knitted fabric according to claim 1, wherein the above-described fiber-forming thermoplastic polymer is selected from polyesters, polyamides, polyvinylidene chloride, and polypropylene.

3. The flat multifilament yarn knitted fabric according to claim 1, wherein the ratio (C1/C2) of the maximum value (C1) of the width to the minimum value (C2) in the flat cross section of the above-described filament is 1.05 to 4.00.

4. The flat multifilament yarn knitted fabric according to claim 1, wherein the above-described filament yarn contains a matting agent in an amount of not less than 0.2 percent by weight.

5. The flat multifilament yarn knitted fabric according to claim 1, wherein the total fineness of the above-described multifilament yarn is 20 to 170 dtex, and the fineness of the single filament is 0.5 to 5 dtex.

6. The flat multifilament yarn knitted fabric according to claim 1, wherein the above-described knitted fabric has a knit construction selected from ponti roma, Milano rib, tuck rib, back seed stitch (back Kanoko), single pique, double pique, half, satin, back half, queens cord, shark skin, double raschel, and double tricot.

7. The flat multifilament yarn knitted fabric according to claim 1, wherein the bulkiness of the above-described knitted fabric, measured by JIS L 1018-1998, 6. 20, is not less than 2.1 $cm^3/g$.

8. The flat multifilament yarn knitted fabric according to claim 1, wherein the flexural rigidity of the above-described knitted fabric, measured with a KES hand-measuring system, is not more than 0.02 $cN \square cm^2/cm$.

9. The flat multifilament yarn knitted fabric according to claim 1, wherein the water-absorbing speed of the above-described knitted fabric, measured by JIS L 1096:1998, 6. 26, 1(2) B method (Byreck method), is not less than 30 mm.

* * * * *